US009404295B2

(12) United States Patent
Baczuk et al.

(10) Patent No.: US 9,404,295 B2
(45) Date of Patent: Aug. 2, 2016

(54) SLIDING SASH SECONDARY LOCK

(71) Applicant: Milgard Manufacturing Incorporated, Taylor, MI (US)

(72) Inventors: Eric A. Baczuk, Puyallup, WA (US); Travis James Dodge, Olympia, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 0 days.

(21) Appl. No.: 14/712,858

(22) Filed: May 14, 2015

(65) Prior Publication Data

US 2015/0368942 A1 Dec. 24, 2015

Related U.S. Application Data

(63) Continuation-in-part of application No. 14/313,013, filed on Jun. 24, 2014.

(51) Int. Cl.

| | |
|---|---|
| ***E05B 55/00*** | (2006.01) |
| ***E05C 1/08*** | (2006.01) |
| ***E05C 1/10*** | (2006.01) |
| ***E05C 19/00*** | (2006.01) |

(52) U.S. Cl.

CPC . *E05C 1/085* (2013.01); *E05C 1/10* (2013.01); *E05C 19/00* (2013.01)

(58) Field of Classification Search

CPC ..... E05C 1/004; E05C 1/006; E05C 1/08; E05C 1/12; E05C 1/14; E05C 1/145; E05C 1/16; E05C 1/166; E05C 17/46; E05C 17/48

USPC ..... 49/449; 292/57, 58, 62, 137, 172, 177, 292/179, 182, 142, 251.5, 279, DIG. 15, 292/DIG. 31, DIG. 46

See application file for complete search history.

(56) References Cited

U.S. PATENT DOCUMENTS

| | | | | |
|---|---|---|---|---|
| 144,288 | A | | 11/1873 | Rand |
| 1,775,786 | A | | 9/1930 | Harrison et al. |
| 2,692,789 | A | | 10/1954 | Rivard |
| 2,815,975 | A | | 12/1957 | Check et al. |
| 3,556,573 | A | | 1/1971 | Miller |
| 3,565,475 | A | | 2/1971 | Foss |
| 4,005,886 | A | | 2/1977 | Lirette |
| 4,099,753 | A | | 7/1978 | Gwozdz et al. |
| 4,102,545 | A | | 7/1978 | Jay |
| 4,105,233 | A | | 8/1978 | Levey |
| 4,126,912 | A | * | 11/1978 | Johnson ..... 16/81 |
| 4,263,795 | A | | 4/1981 | Van Gompel |
| 4,315,647 | A | | 2/1982 | Wilzig et al. |
| 4,445,717 | A | | 5/1984 | Imhoff |
| 4,763,949 | A | | 8/1988 | Haig |

(Continued)

FOREIGN PATENT DOCUMENTS

| | | | | |
|---|---|---|---|---|
| DE | 3606458 A1 | * | 9/1987 | ..... F16P 3/08 |
| FR | 2742183 A | | 6/1997 | |

(Continued)

*Primary Examiner* — Jerry Redman

(74) *Attorney, Agent, or Firm* — Rathe Lindenbaum LLP

(57) ABSTRACT

A sliding fenestration sash assembly includes a sliding sash and a frame having a first longitudinal member including at least one aperture. A pin is operatively connected to a handle and movable between a first position and a second position. The pin being biased into the aperture by the biasing member when the pin is aligned with the aperture.

20 Claims, 7 Drawing Sheets

(56) References Cited

U.S. PATENT DOCUMENTS

| | | | | |
|---|---|---|---|---|
| 5,076,620 | A | 12/1991 | Campbell et al. | |
| 5,285,596 | A | 2/1994 | Kinsey | |
| 5,375,894 | A | 12/1994 | Schlack | |
| 5,410,841 | A | 5/1995 | Harris et al. | |
| 5,561,994 | A | 10/1996 | Smith et al. | |
| 5,715,631 | A | 2/1998 | Kailian et al. | |
| 5,868,445 | A * | 2/1999 | Kaufman et al. | 292/251.5 |
| 6,118,852 | A | 9/2000 | Rogers et al. | |
| 6,409,231 | B1 | 6/2002 | Rusiana | |
| 6,415,565 | B1 | 7/2002 | Sosa | |
| 6,418,193 | B1 | 7/2002 | Albagli | |
| 6,526,695 | B1 | 3/2003 | Nguyen | |
| 6,607,221 | B1 | 8/2003 | Elliott | |
| 6,883,837 | B1 | 4/2005 | Lin | |
| 7,024,821 | B2 | 4/2006 | Lu | |
| 7,201,408 | B2 | 4/2007 | Cennamo | |
| 7,712,799 | B2 | 5/2010 | Peng | |
| 8,191,937 | B2 | 6/2012 | Lin | |
| 8,534,719 | B2 | 9/2013 | Chow | |
| 2007/0029812 | A1 | 2/2007 | Monts de Oca | |
| 2009/0041196 | A1 | 2/2009 | Matoba et al. | |
| 2011/0148126 | A1 * | 6/2011 | Macernis | 292/251.5 |
| 2012/0051496 | A1 | 3/2012 | Wang et al. | |
| 2012/0061033 | A1 | 3/2012 | Ona Gonzalez et al. | |
| 2015/0159429 | A1 | 6/2015 | Lund | |

FOREIGN PATENT DOCUMENTS

| | | | | |
|---|---|---|---|---|
| GB | 1480969 | A * | 7/1977 | |
| JP | 03212589 | A * | 9/1991 | E05C 19/16 |
| JP | 09177391 | A * | 7/1997 | E05B 15/02 |
| JP | 2001152734 | A * | 6/2001 | E05F 1/02 |
| JP | 2005113402 | A * | 4/2005 | E05F 7/00 |

* cited by examiner

SLIDING SASH SECONDARY LOCK

CROSS-REFERENCE TO RELATED PATENT APPLICATIONS

This application is a continuation-in-part of U.S. patent application Ser. No. 14/313,013 filed Jun. 24, 2014 entitled Sliding Sash Secondary Lock which is incorporated herein in its entirety.

BACKGROUND

The present invention relates generally to the field of a sliding sash for a fenestration assembly and more particularly to a secondary lock for a sliding sash. A sliding slash is moved between a fully closed and opened position to allow ingress and egress from a structure. A primary lock secures the sliding sash in a fully closed position.

SUMMARY

In one embodiment an apparatus for a sliding fenestration sash assembly comprises a sliding sash sliding with a frame having a first longitudinal member including at least one aperture. A secondary lock mechanism includes a handle positioned in the sliding sash and being movable from a first handle position to a second handle position. A pin is operatively connected to the handle and movable between an extended position and a retracted position as the handle moves between the first handle position and the second handle position. The pin being biased into the aperture by the biasing member when the pin is aligned with the aperture.

DETAILED DESCRIPTION OF THE EXAMPLE EMBODIMENTS

Figure 1:
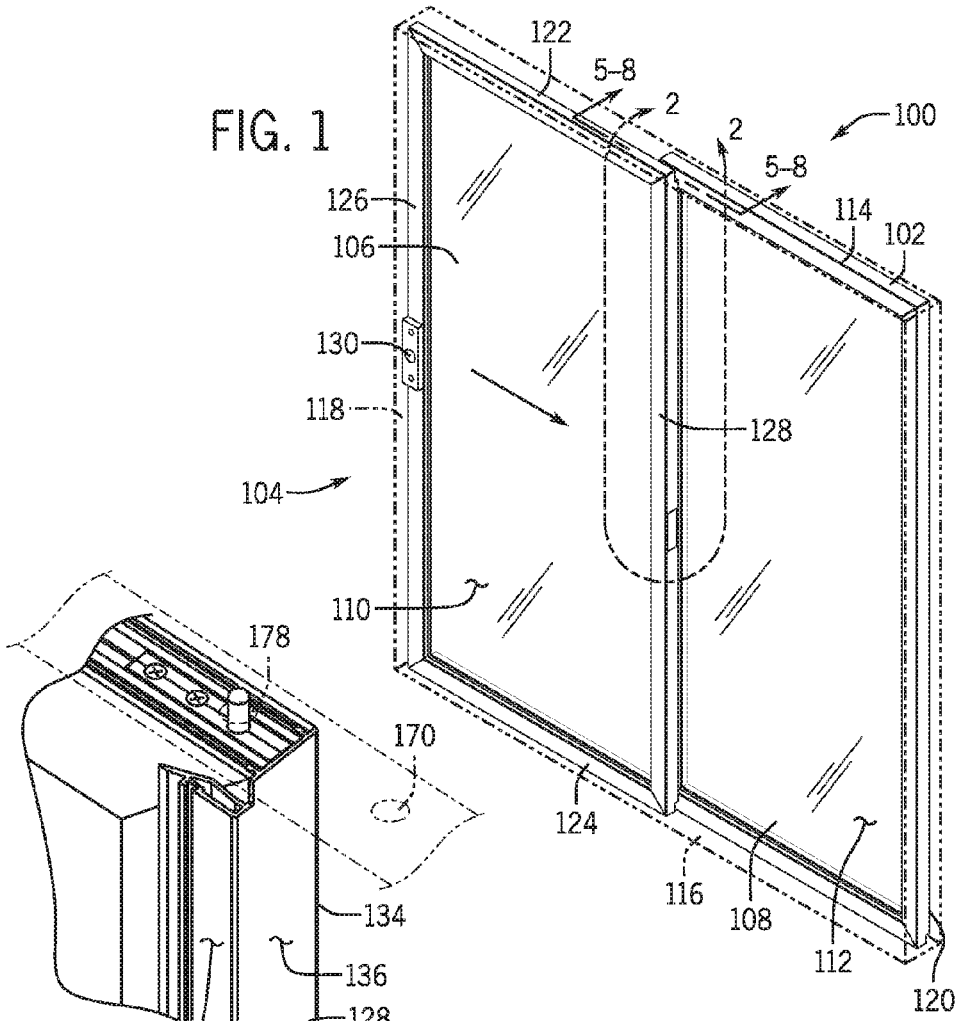
FIG. 1 is a sliding sash in a fenestration opening.

Referring to FIG. 1 a fenestration assembly 100 includes a frame 102 for an architectural element 104 as a sliding door or window in an opening for an architectural structure such as building. In one embodiment the sliding door 104 is a sliding door having a sliding sash 106 and a fixed sash 108. However as discussed further below sliding sash 104 may be employed as a window or other type of fenestration structure. The window may be a double hung or single hung window or other type of windows known in the art that has a sliding sash.

To provide an orientation for discussion, the term outwardly direction will refer to the direction that faces away from the building structure that supports the fenestration assembly in a vector direction from the inside of the building structure toward the outside of the building structure. If a user is standing outside of a building and looking at the fenestration assembly the user would see the outwardly surfaces of the fenestration assembly. Similarly, if a person is standing inside of a building structure and looking at the fenestration assembly the user would see the inwardly surfaces of the fenestration assembly.

Unless otherwise indicated, the directions used herein reflect the orientation of a user facing the fenestration assembly from the interior of an enclosure or building structure. Inwardly includes the direction away from the window towards the user and the interior of an enclosure, up and down include the direction away from and toward the direction of gravity, while left and right include the direction as viewed by a user facing the window from the interior of an enclosure. The term front will include the surfaces facing the interior of the enclosure while the term back will include the surfaces or regions facing away from the interior of the enclosure.

In one embodiment fenestration assembly is a sliding door such as a sliding patio door having a sliding sash 106 that moves on a track operatively secured to the frame 102. Sliding sash 106 may be an internal sliding sash in which sliding sash moves relative to fixed sash 108 such that sliding sash 106 is inward of fixe sash 108. Stated another a plane defined by glazing 110 is inward of the plane defined by glazing 112 of fixed sash 108.

Referring to FIG. 1, frame 102 includes a header 114, a sill 116 and a first jamb 118 and a second jamb 120. Sliding sash 106 includes a top rail 122, an opposing bottom rail 124. The top rail 122 and bottom rail 124 are parallel to one another. Sliding sash 106 includes a first stile 126 and a second stile 128 spaced from and parallel to first stile 126. First stile 126 and second still 128 are perpendicular to top rail 122 and bottom rail 124. Sliding sash 106 may include a primary lock mechanism 131 of the type known in the art such as a mortise lock to operatively lock sliding sash 106 to first jamb 118.

Figure 2:
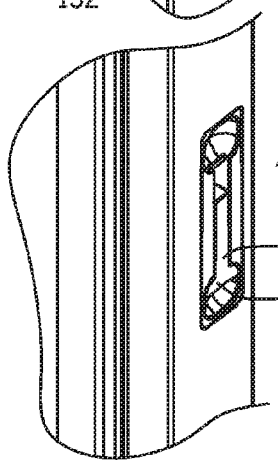
FIG. 2 is an isometric view of a handle and secondary lock taken generally along lines 2-2 of FIG. 1.

Referring to FIG. 2, sliding sash 106 includes a secondary lock 130 operatively connected to second stile 128. Secondary lock 130 locks sliding sash relative to frame 102 in a position other than a fully closed position. Sliding sash 106 is in a fully closed position when first stile 126 is adjacent to first jamb 118 of frame 102. Sliding sash 106 may be moved by from the fully closed position to an open position by moving sliding sash 106 away from first jamb 118 toward second jamb 120. In the embodiment of a sliding door, sliding sash 106 is slid on a track in the sill and/or header in direction away from first jamb 118 toward second jamb 120 to open the sliding door and back toward first jamb 118 to close the sliding door.

Figure 3:
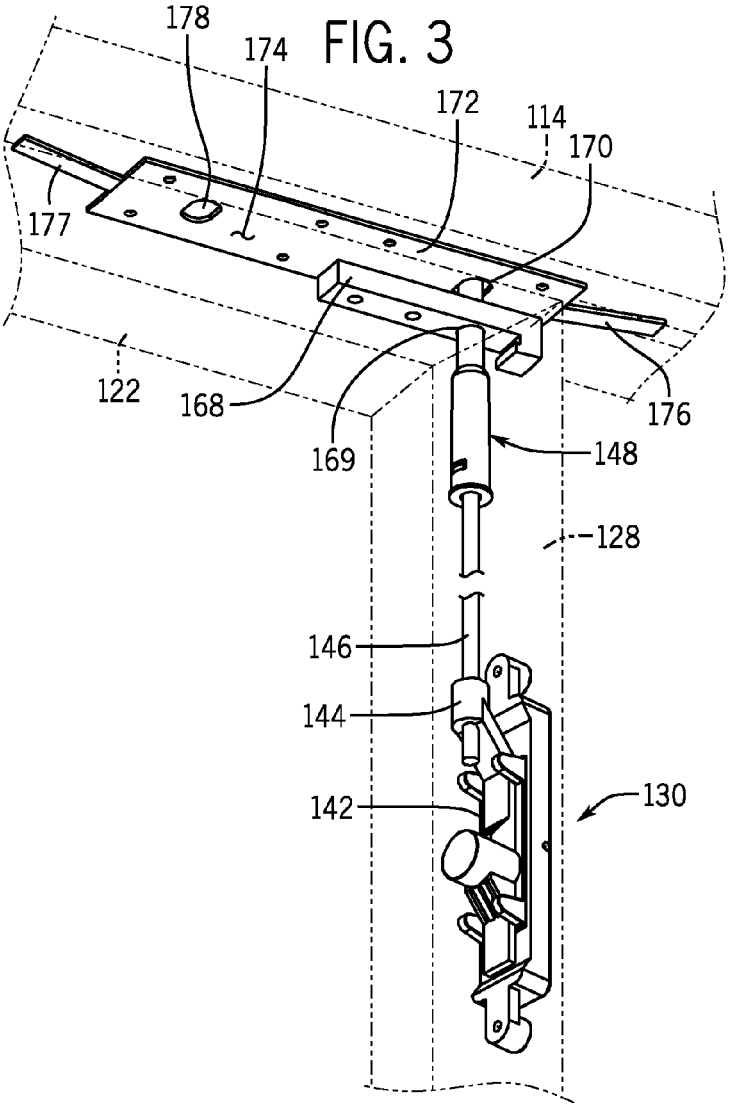
FIG. 3 is a partial isometric view of the secondary lock in a locked position.

Second stile 128 includes a front or inwardly facing surface 132 an opposing outwardly or rear surface 132 and a leading edge surface 136 that extends between and is perpendicular to front surface 132 and rear surface 134. Referring to FIG. 2 and FIG. 3 secondary lock 130 includes a handle 138 having a free end 140. In one embodiment handle 138 pivots between a disengaged position with free end 140 begin above a pivot end 142 and an engaged position in which free end 140 is below pivot end 142.

In one embodiment handle 138 is located within second stile 128 that is remote from jamb 118 such that first stile 126 is adjacent jamb 118 when sliding sash 106 is in the fully closed position. First stile 126 is intermediate jamb 118 and second stile 128. In one embodiment handle 138 is accessed by a user from leading edge surface 136 of second stile 128. In one embodiment, handle 138 is not visible to a user when the user is standing inside the structure and looking directly outwardly. Of course it may be possible to view handle 138 if the user is at an angle to sliding sash 106 such that leading edge surface 136 is visible. In another embodiment (not shown) handle 138 may be positioned such that handle 138 may be activated through the interior surface or front surface 132.

Referring to FIG. 3 secondary lock 130 includes an actuation mechanism 142 that mechanically converts the movement of handle 140 from the disengaged position to the engaged position to an up and down movement of a connector 144. A bar 144 operatively connected to connector 144 is moved in a vector direction parallel to the longitudinal axis of second stile 128. A pin assembly 148 is operatively secured to a distal end of bar 144.

Figure 4:
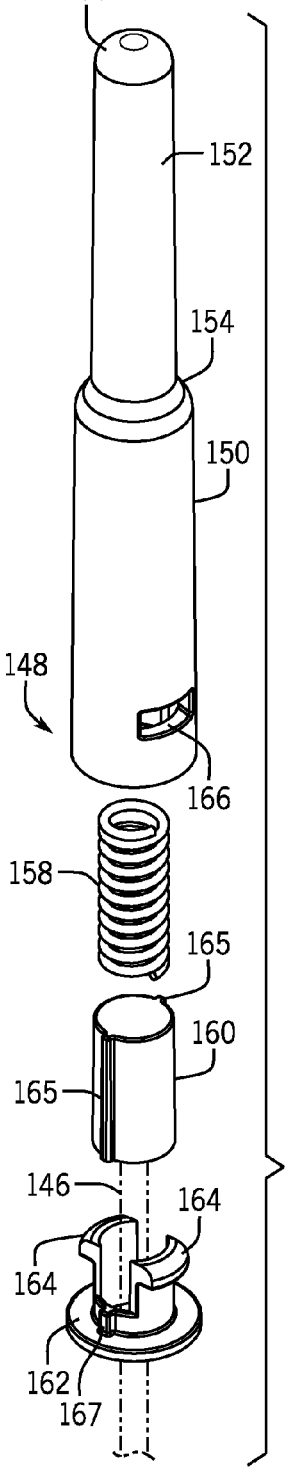
FIG. 4 is an exploded view of the pin bias mechanism.

Referring to FIG. 4 pin assembly 148 includes a housing 150 that receives pin 152. Pine 152 includes a base portion that is located within housing 150. In one embodiment base portion of pin 152 has a diameter greater than the diameter of the opening 154 of housing 150. Pin 152 includes a free end 156 having a beveled or rounded portion. Pin 152 is biased in a direction through opening 154 of housing 150 by a biasing member 158 which in one embodiment is a coil spring. Spring 158 is located within a hollow portion of housing 150 and extends between the base portion of pin 152 and a spring support member 160. Spring support member 160 is operatively connected to bar 146 via a base clip 162. In one embodiment spring support member 160 includes a pair of outwardly extending protrusions or guides 165 that extend from a bottom portion of spring support member 160 toward the top portion of spring support member 162 in a direction parallel to the longitudinal axis of spring support member 160. Guide 165 locates spring support member 160 within a corresponding pair of recesses 167 in base clip 162. In this manner spring support member 160 is able to slide through an aperture in base support 162. Bass clip 162 includes a pair of tabs 164 proximate a top portion of base clip 162 that are received within a pair of apertures 166 in the bottom portion of housing 150. In one embodiment pin has a generally cylindrical shape. In one embodiment pin may have a tapered end. In one embodiment pin is a locking member that includes a shape that is other than cylindrical.

Referring to FIG. 3 a support 168 having an aperture 169 is operatively connected to header 122 of sliding sash 106 to provide a guide for pin 152. Pin 152 extends through aperture 169 and is guided by the interior walls of aperture 169 as pin 152 moves between an engaged and disengaged positions. Support 168 provides lateral support and strength of secondary lock for pin 152.

Pin 152 is removably received within an aperture 170 in header 114. In one embodiment a guide plate 172 is operatively secured to header 114. Guide plate 172 includes at least one aperture in alignment with aperture 170 in header 114. Guide plate 172 includes a generally planar surface 174 and a first beveled portion 176 extending from one end of planar surface 174. Beveled portion 176 provides a ramp for pin 156 to ride upon and be guided onto planar surface 174 as sliding sash is moved between the closed position and open position. In one embodiment as second beveled portion 177 extends from a second end of planar surface 174.

When pin 152 is engaged in aperture 170 in header 114 any movement of sliding sash 106 in the inward/outward direction or left/right direction will be resisted by contact of pin 152 both one or both the walls of aperture 170, the edge of the corresponding aperture in guide plate 172 and/or the aperture in support 168.

Referring to FIG. 2 secondary lock 130 is in a first locked position with handle 138 in an engaged position with free end 140 of handle 138 in a generally downward orientation. In the first locked position, sliding sash 106 is in the closed position with stile 128 adjacent 118. Pin 152 extends upward into aperture 178 thereby providing a lock of sliding sash 106 relative to frame 102. It is contemplated that a traditional primary is provided locking sliding sash 106 directly to jamb 118.

Figure 5:
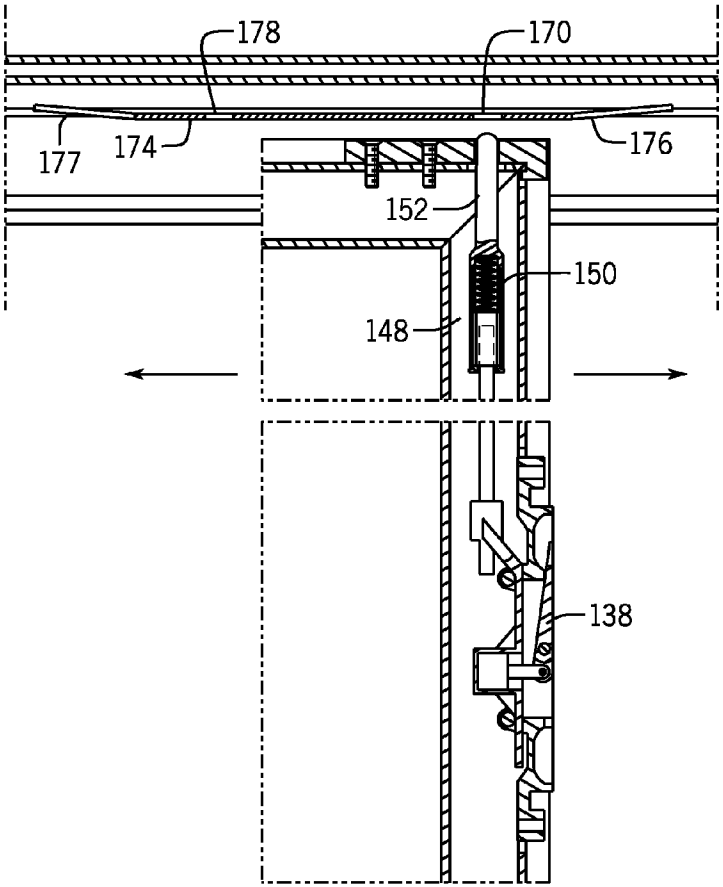
FIG. 5 is a cross-sectional view of the sliding sash with the secondary lock in the disengaged unlocked position, taken generally from drawing line 5-8 of FIG. 1.

Referring to FIG. 5, secondary lock 130 is in a disengaged position with pin 152 being in a lowered withdrawn position such that pin 152 is not located within aperture 170 and does not impede the movement of sliding sash 106 relative to jamb 118 as the sliding sash 106 is moved toward and away from jamb 118. In one embodiment stile 126 of sliding sash 106 is moved away from jamb 118 a set distance until pin assembly 148 is located directly beneath aperture 170 in header 114.

Figure 6:
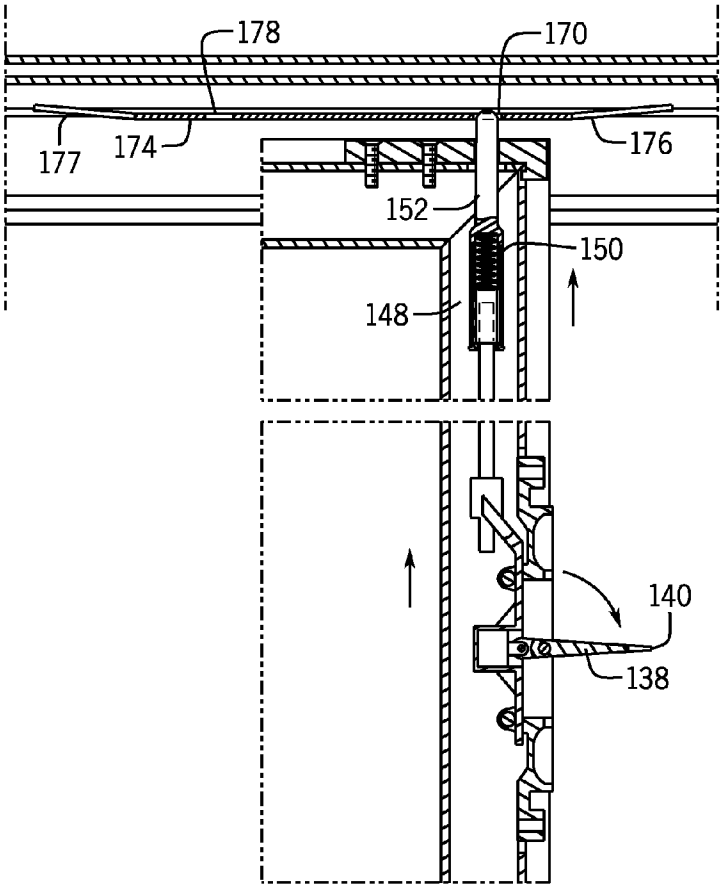
FIG. 6 is a cross sectional view of the sliding sash with the secondary lock moving from the disengaged unlocked position toward the engaged locked position, taken generally from drawing line 5-8 of FIG. 1.

Referring to FIG. 6 once sliding sash 106 is positioned between a fully closed position in which stile 126 is adjacent jamb 118 and a fully opened position such that pin assembly 148 is directly below or in longitudinal alignment aperture 170 secondary lock 130 may be activated. In one embodiment, it may be desired to space sliding sash a distance sufficient to allow air to enter between sliding sash 106 and jamb 118 but less than a distance that would allow a person to enter between the sliding sash and jamb. For example if the rail 126 was spaced six inches from jamb 118 in a direction toward jamb 120, air would be allowed to enter the structure between sliding sash 106 and frame 102 but a person would not be allowed to enter through the six inch space. Secondary lock 130 may be used to lock sliding sash 106 in a fixed position between the closed and fully opened position.

Figure 7:
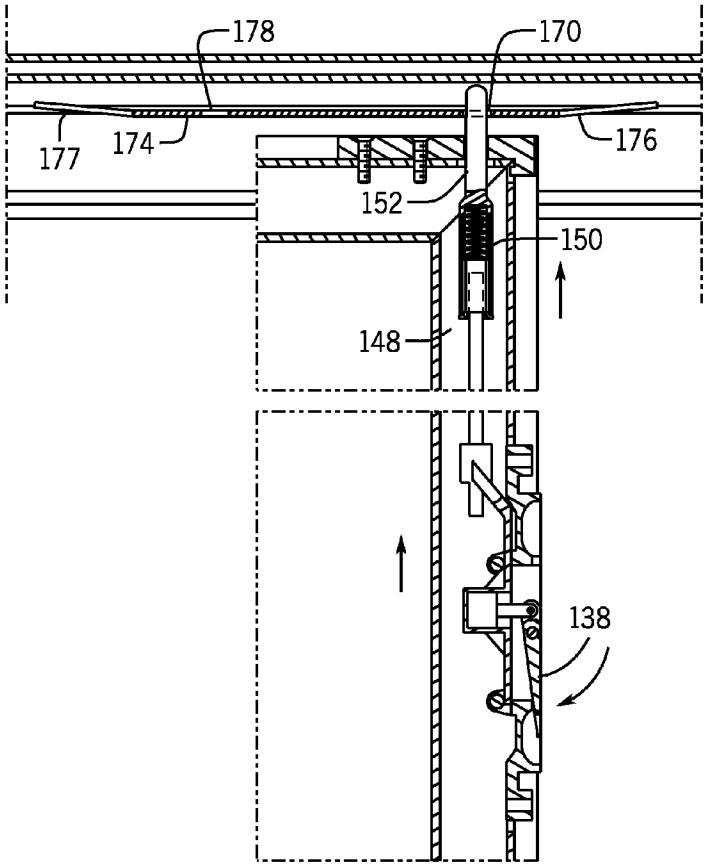
FIG. 7 is cross-sectional view of the sliding sash with the secondary lock in the engaged and fully locked position, taken generally from drawing line 5-8 of FIG. 1.

Referring to FIG. 6 sliding sash 106 is positioned a fixed distance from jamb 118 such that pin 152 is positioned directly under aperture 170 or stated another way depending on the orientation of secondary lock 106 and aperture 170, the longitudinal axis of pin assembly 158 is in longitudinal alignment with aperture 170. In this aligned position, handle 138 is moved by a user from the disengaged position to an engaged position by moving free end 140 of handle 138 from a first position to a second position as illustrated in FIG. 7. In the engaged position handle operatively moves bar 144 in a direction toward header 114 such that free end 156 of pin 152 is moved into aperture 170 in header 114. In this manner sliding sash 106 is locked in a position between a fully closed position and a fully opened position.

Figure 8:
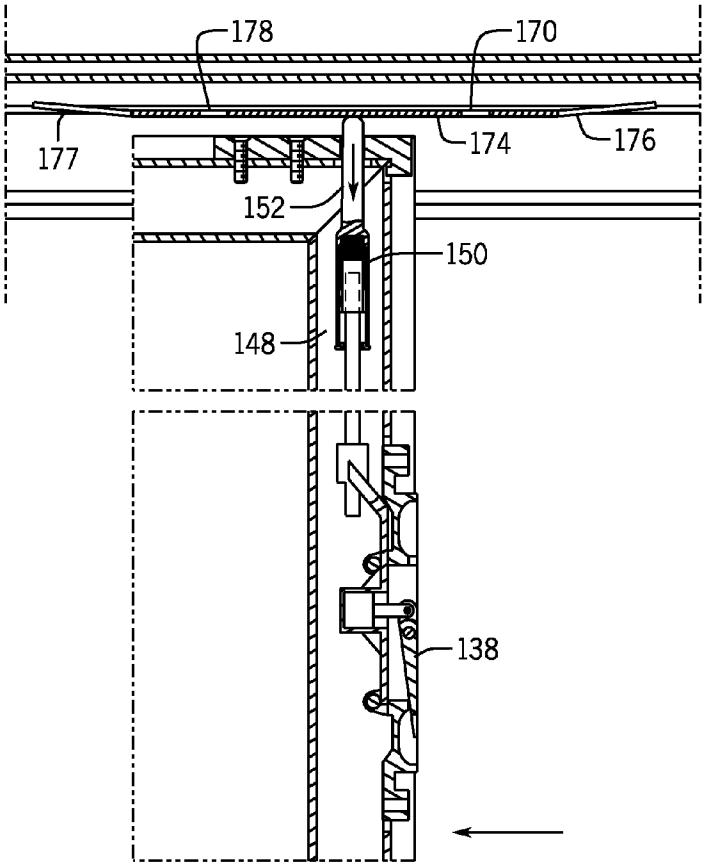
FIG. 8 is a cross-sectional view of the sliding sash with the secondary lock in the engaged but not locked position, taken generally from drawing line 5-8 of FIG. 1.

Referring to FIG. 8, secondary lock 130 handle 138 may be moved from a disengaged position to an engaged position when pin assembly 148 is not in longitudinal alignment with aperture 170. In this scenario, as end 140 is moved from the disengaged to engaged position free end 156 of pin 152 is moved toward header 114. If pin assembly is not in longitudinal alignment with the longitudinal axis of aperture 170 then free end 156 of pin 152 will abut against a surface 174 of guide plate 172. As pin 152 is moved against the surface 174 of guide plate 172 pin 152 moves into the cavity of guide 150 by depressing spring 158. Once sliding sash 106 is moved to a position such the longitudinal axis of pin 152 is alignment with aperture 170 the spring force of spring 158 will bias pine 152 from housing 150 such that the free end of pin 156 and the upper portion of pin 152 will be received within aperture 170.

Figure 15:
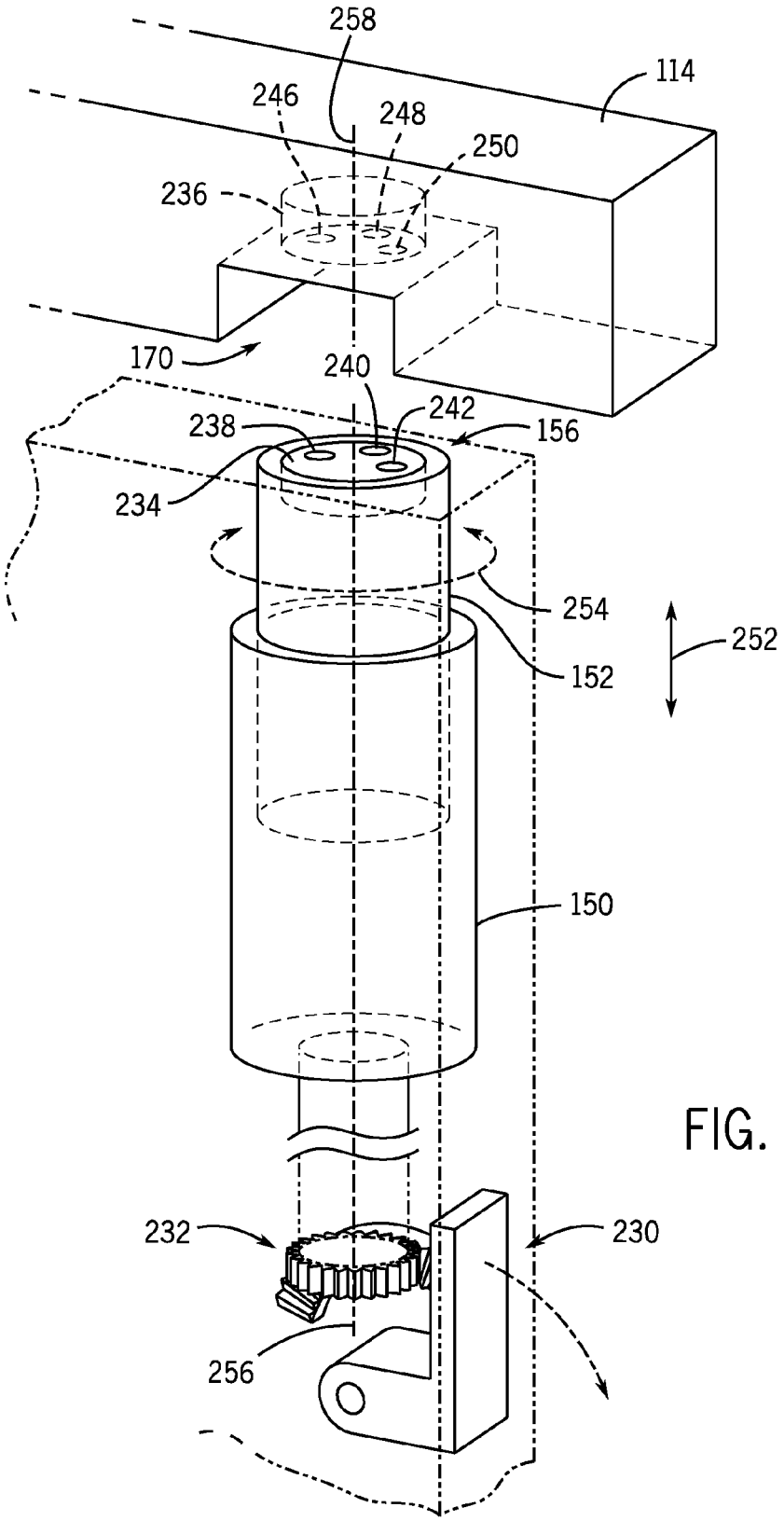
FIG. 15 is an isometric exploded view of one embodiment of a secondary lock.

Referring to FIG. 15 when secondary lock 130 is moved to the engaged position when the longitudinal axis of pin assembly 148 is positioned outside of the guide plate 174 the free end 156 of pin 152 will engage the exposed portion of header 114. Pin 152 will be moved into housing 150 as bar 146 is moved toward header 114. Similar to the discussion above, spring 158 will be compressed to allow pin 152 to enter housing 150. As sliding sash 106 is moved left and/or right free end 156 of pin 152 will slide along header 114 until the free end 156 contacts guide plate 172. Beveled regions 176 and 178 provide a ramped entrance to surface 174 of guide plate 172. The curved or beveled portion of free end 156 of pin 152 permit pine 152 to easily make the transition from direct contact with header 114 and guide plate 172. Spring 158 maintains the free end 156 of pin 152 in contact with header 114, beveled portion 176 or 178 and surface 174 of guide plate 172 as sliding sash is moved relative to frame 102. When sliding sash 106 is moved to a position where the longitudinal axis of pin assembly 148 is in alignment with the longitudinal axis of aperture 170 spring 158 biases pin 152 into aperture 170.

In one embodiment more than one aperture is provided in header 114. Referring to FIG. 3 a second aperture 178 is provided to allow a user to select between more than one location to lock sliding sash to frame 102 between the fully closed and fully opened position.

To disengage secondary lock 130, a user manipulates handle 138 by moving free end 140 from the engaged position to the disengaged position. The movement of handle 188 from the engaged to disengaged position operatively moves bar 144 away from aperture 170 or 178 and removes pin 152 from aperture 170 or 178. In the disengaged position, sliding sash 106 is free to move back to the fully closed position and or any other position between the fully closed position and fully open position.

In one embodiment biasing member 158 may be a magnet or other type of mechanism that will act to bias pin 152 into aperture 170 or 178. In one embodiment a magnet may positioned within housing 150 that provides a magnetic force against pin 152 that biases pin 152 toward header 114. In this embodiment a first magnet may be located proximate the base of housing 150 and/or on bias support member 160. A second magnet may be located on or within pin 152 so that a magnetic force biasing pin 152 toward header is created. Alternatively, a magnet may be positioned within or proximate aperture 170 of header 114 to provide a magnetic force attracting pin 152 toward header 114 and/or within aperture 170 or 178. In this embodiment pin 152 would not impact or contact header 114 or guide plate 172 when handle is moved to the engage position. Rather in this embodiment pin 152 would only be biased into aperture 170 or 178 when pin 152 was in longitudinal alignment with aperture 170 or 178.

It also contemplated that sliding sash 106 may be an external sliding sash in which sliding sash 106 is outward of fixed sash 108. In this type of sliding door the plane defined by glazing 110 of exterior sliding sash is outward of the plane defined by glazing 112 of fixed sash 108. Since leading edge 136 of second stile 128 would be outside of the structure when the external sliding sash was moved to a partially open position a secondary lock located on the second stile 128 would be accessible from the outside of the structure but would not operate as an effective lock from within the inside of the structure. A secondary lock could be positioned on the first stile that is closer to the jamb that the sliding sash is locked to in the closed position. However, in this position a person from the exterior of the structure would have easy access to manipulate the handle and move the secondary lock to the disengaged and unlocked position. In one embodiment secondary lock 130 handle 138 is located on first stile and provided with a key lock that would prevent unauthorized manipulation of the secondary lock without a key.

Figure 9:
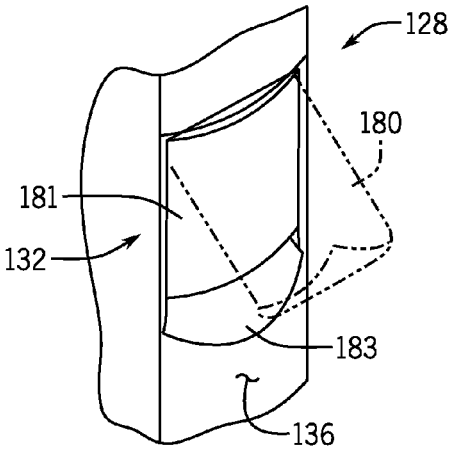
FIG. 9 is an isometric view of a handle of one embodiment.
Figure 10:
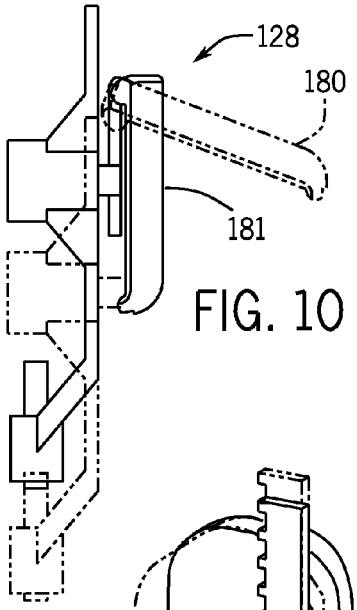
FIG. 10 a side view of the handle of FIG. 9.

Referring to FIGS. 9-14 other handles are contemplated to manipulate pin assembly 148. Referring to FIGS. 9 and 10 a handle 180 is positioned within second stile 128 and moves between a first position in which an exposed surface 182 is substantially parallel with a plane defined by the leading edge surface 136 when the secondary lock is in a disengaged position in which exposed surface 182 is at an angle relative to the plane defined by the leading edge surface 136 when the secondary lock is in the engaged position. In this embodiment, handle 180 provides a visual indicator that the secondary lock in the engaged and/or disengaged position. The visual indicator being whether the angle of the exposed surface 182 is co-planar with the plane defined by the leading edge surface 136 or not. The solid and dashed lines in FIG. 9 illustrate the movement of the secondary lock between the disengaged position (solid lines) and engaged position (dashed lines). Similar to handle 138 discussed above handle 180 operates completely between the inner surface 132 and outer surface 134 of second stile 128. Handle 180 is located within a recess 181 of second stile 128 when secondary lock is in the disengaged position. A beveled finger depression 183 extends from leading edge surface 136 toward recess 181 to allow a user to easily engage a free end of handle 180 to move handle 180 from the disengaged position to the engaged position thereby moving pin 132 toward and away from header 114.

Figure 11:
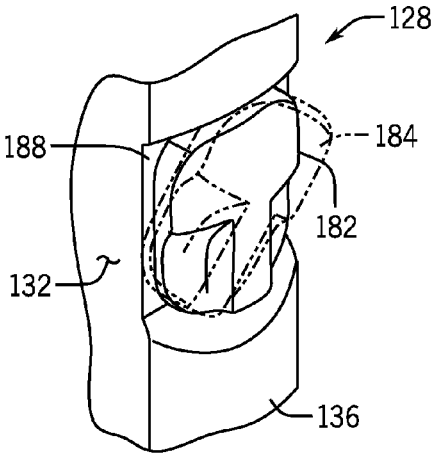
FIG. 11 is an isometric view of a handle of another embodiment.
Figure 12:
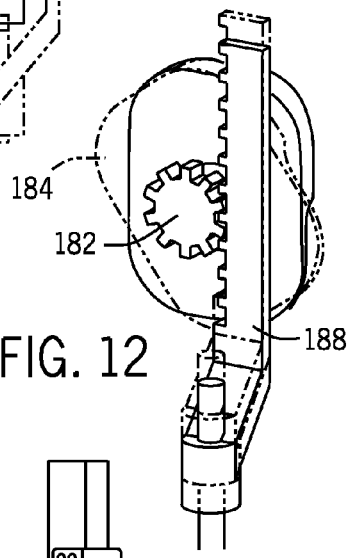
FIG. 12 side view of the handle of FIG. 11.

Referring to FIGS. 11 and 12, in one embodiment a handle 182 positioned within second stile 128 and moves between a first position in which an exposed surface 182 is remains substantially parallel with a plane defined by the leading edge surface 136 when the secondary lock is both in a disengaged position and an engaged position. A lateral edge 184 of handle 182 however extends beyond the outer surface 134 or in an alternative embodiment extends beyond inner surface 132 when secondary lock 130 is in the engaged position. When secondary lock 130 is in the disengaged position handle 182 is located fully between the inner surface 132 and outer surface 134 of stile 128. Handle 182 is positioned within a recess 185 in second stile 128 from leading edge surface 136.

Figure 13:
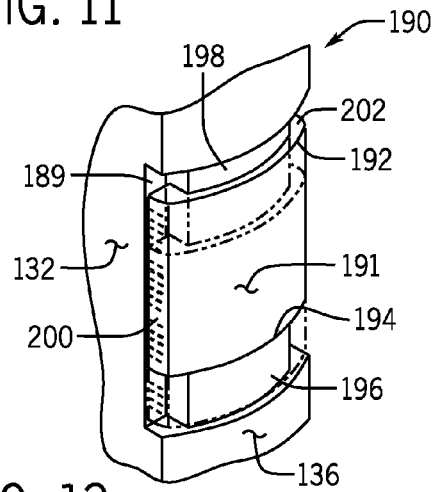
FIG. 13 is an isometric view of a handle of another embodiment.
Figure 14:
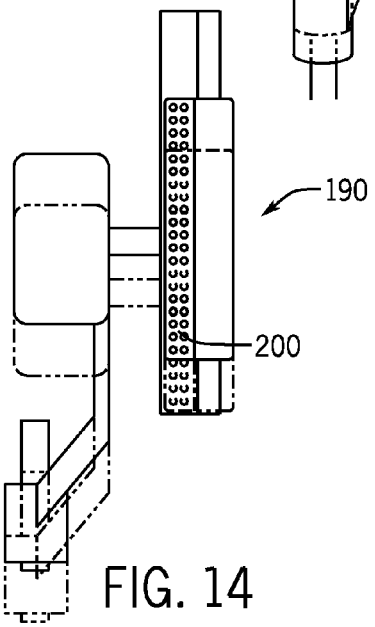
FIG. 14 a side view of the handle of FIG. 13.

Referring to FIGS. 13 and 14, in one embodiment a handle 190 is used to activate secondary lock 130. Handle 190 includes a first exposed surface 191 that is substantially parallel with the leading edge surface 136 of second stile 128. Handle 190 moves in a direction toward and away from header 114 to move the secondary lock from an engaged and disengaged position. Handle 190 includes side portions 200, 202 that may are accessible from surface 132 and 134 of second stile 128. In this manner handle 190 may manipulated by a user engaging surfaces 200 and 202 with a thumb and index finger and sliding the handle 190 in the upwardly and downwardly direction toward and away from header 114. Handle 190 operates completely within a recess 198 of second stile 136 defined as a region from lading surface 136 toward first stile 126. In one embodiment a region 196 may have a color or other indicia that indicates that the lock is in the engaged position.

Referring to FIG. 14 and FIG. 15 in one embodiment, biasing element 158 is not included in housing 150. FIG. 14 and FIG. 15 are not drawn to scale. Note that the components may have different shapes and different relative shapes. Specifically housing 150 and pin 152 may have varying lengths and sizes depending on the location of the handle of secondary lock 130, 230 relative to the header. In one embodiment a magnet is provided in the upper end of pin 152 proximate free end 156. A second magnet is provided in header 114 within apertures 170 and/or 178. In this embodiment, the guide plate 172 may be eliminated and/or ramp portions 176 and 177 may be eliminated. In this embodiment when handle 138 is moved from a non-engaged to an engaged position the free end 156 of pin 152 is not biased against header 114. Accordingly, a guide plate 174 and ramps 176, 177 are not required. In this embodiment when secondary lock 130 is in the engaged position housing 150 and pin 152 are moved toward header 114. However, in the engaged position of secondary lock 130 the free end 156 is located a distance below header 114. In the engaged position the free end 156 of pin 152 enters aperture 170 into header 114 only when the door is opened to a position where pin 152 is directly below aperture 170. When pin 152 is directly below the aperture 170 and/or 178 in header 114 the magnetic force between the magnet within pin 152 and the magnet within aperture 170 causes the pin to move upwardly into aperture 170 or 178 in the header 114. Pin 152 moves within housing 150 between a disengaged position in which the free end 156 of pin 152 is located below header 114 and an engaged position in which free end 156 of pin 152 is located within aperture 170 or 178 in header 114.

In this embodiment ramp 176 and 177 may not be needed since there is no need to provide a surface for the upper end or free end 156 of pin 152 to ride along when the secondary lock 130 handle 138 is in the engaged position. Stated another way in this embodiment, the free end 156 of pin 152 remains below header 114 until the longitudinal axis of pin 152 is substantially aligned with the longitudinal axis of the aperture 170 or 178.

In one embodiment, one of the magnets in pin 152 and header 114 is replaced with a metal material such that there is a magnetic force between the metal material and the magnet that causes pin 152 to move upwardly into aperture 170 or 178 in header 114 when pin 152 in directly below aperture 170 or 178. Stated another way when the longitudinal axis of the pin 152 is substantially aligned with or co-linear with the longitudinal axis of aperture 170 or 178 a magnetic force between the magnet and metal material causes pin 152 to move along its longitudinal axis in a direction toward the header such that the free end of pin 152 is positioned within aperture 170 or 178 of header 114.

Referring to FIG. 15 a secondary lock 230 includes a mechanism 232 that both translates housing 150 and pin 152 along the longitudinal axis of pin 152 in a direction 252 and rotates pin 152 about its longitudinal axis in a direction 254. In one embodiment a pair of correlated magnets programmable magnets 234 and 236 as known in the art are positioned proximate free end 156 of pin 152 and within header 114 proximate or within aperture 170 and/or 178. Correlated magnets are of the type developed by Correlated Magnetics Research, LLC and generally described in U.S. Pat. No. 7,800,471 and the patents that claim priority thereto and which is incorporated herein by reference. In one embodiment the correlated magnets 234, 236 are programmed to attract one another with a prescribed force and with a predetermined engagement distance such that pin 152 will be biased into aperture 170 or 178 only when the longitudinal axis 256 of pin 152 is substantially co-planar or coplanar with the longitudinal axis 258 of aperture 170 or 178. In one embodiment the correlated magnets 234, 236 are programmed such that the magnetic force will occur between the magnet in pin 152 and aperture 170 or 178 only when the magnets are rotationally aligned. By way of a non-limiting example, correlated magnet 234 may have varying polarity at locations 238, 240 and 242 that oppositely correspond to locations 246,248 and 250 respectively on magnet 236. Accordingly, pin 152 will only be biased into aperture 170 or 178 when the magnet in pin 152 is rotationally aligned about the longitudinal axis of pin 152 that is aligned with the rotational orientation of the magnet within aperture 170 or 178 respectively. In one example magnet 234 and 236 are only attracted toward one another when elements 238, 240 and 234 are aligned with elements 246, 248 and 20 respectively.

Figure 16:
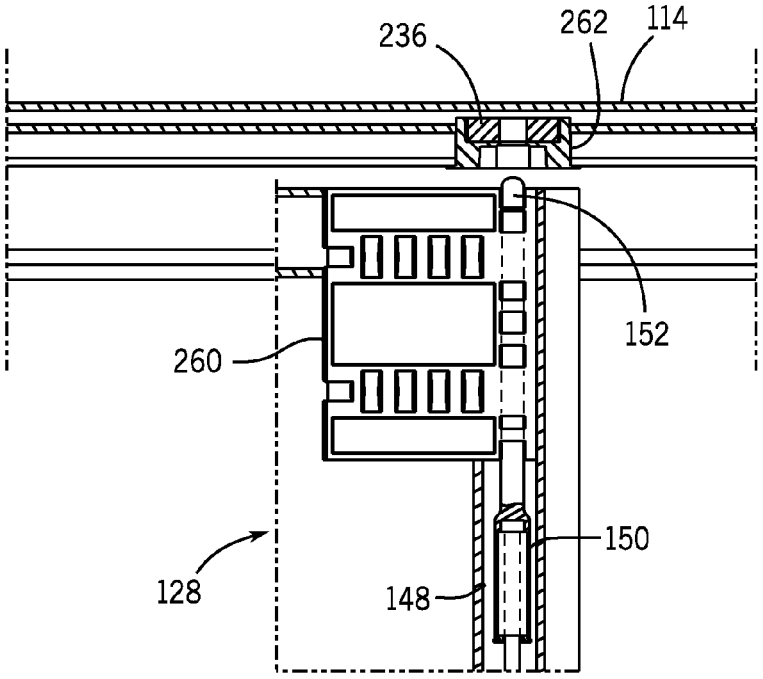
FIG. 16 is a cross-sectional view of a corner key and secondary lock assembly in a disengaged position, taken generally from drawing line 5-8 of FIG. 1 in one embodiment.
Figure 17:
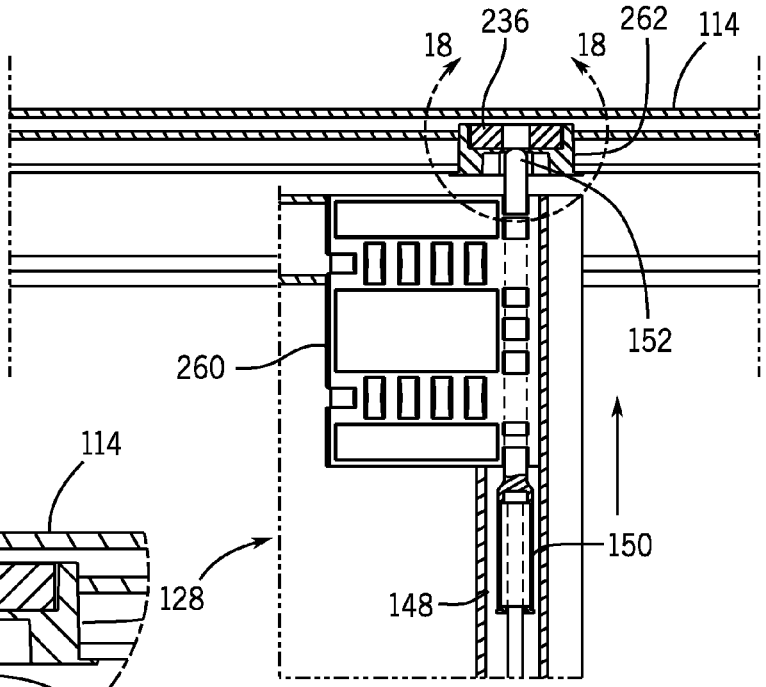
FIG. 17 is a cross-sectional view of a corner key and secondary lock assembly in a disengaged position, taken generally from drawing line 5-8 of FIG. 1 in one embodiment.
Figure 18:
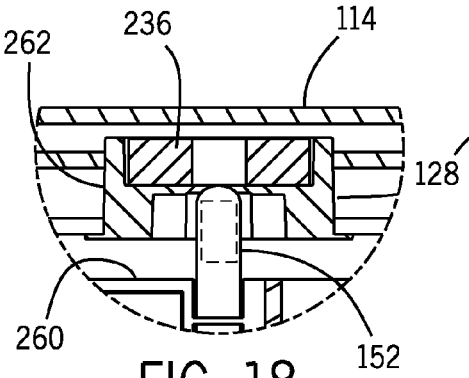
FIG. 18 is a close up view of the magnets in one embodiment.

Referring to FIGS. 16 and 17 a corner key 260 is positioned within top rail 122 and stile 128 to operatively secure top rail 122 and stile 128 together. Pin 152 moves along and about its longitudinal axis 256 within a longitudinal channel within corner key 260. Referring to FIGS. 16, 17 and 18 a housing 262 operatively supports magnet 236 within header 114. An opening in housing 262 received the free end for pin 152 when the secondary lock is in the engaged position. In one embodiment the face of magnet 234 facing header 114 and the face of magnet 236 facing sliding sash 104 are proximate one another when the secondary lock is in the engaged position. In another embodiment, magnet 234 in pin 236 may extend through an aperture in magnet 236 and either be co-planar magnet 236 or be located above magnet 236. Stated another way magnet 234 may extend through an aperture in magnet 236 and be located further from sliding sash 104 than magnet 236. Housing 262 may used in the embodiment illustrated in FIG. 15. Housing 262 may hold magnet 236 and provide aperture 170.

In one embodiment movement of handle 138 only acts to rotate pin 152 about the longitudinal axis 258 of pin 152. As the sliding sash is moved from the closed to open position magnets bias the free end of the pin into the aperture. To disengage the free end of pin 152 from the aperture a user activates handle 138 to rotate pin about the longitudinal axis of the pin thereby breaking the magnetic bond between the first and second correlated magnets. The force of gravity will cause the free end of the pin to drop downwardly away from and out of the aperture allowing the sash to be moved to a fully open or fully closed position. In one embodiment a biasing member such as spring 158 that bias pin 152 away from header 114. In this embodiment the magnetic force between the first and second correlated magnets is stronger than the biasing force of sprint 158 such that when pin 152 is substantially rotationally and/or axially aligned with aperture 170 or 178 the force of the correlated magnets will overcome the force of the spring 158 and the free end of pin 152 will enter into aperture 170 or 178. When a user activates the handle of secondary lock 230 pin 152 rotates about its longitudinal axis thereby breaking the magnetic force of the correlated magnets 234 and 236. As a result the biasing force of spring 158 will retract the free end 156 of pin 152 from aperture 170 thereby releasing the secondary lock and allowing the sash to move relative to the header or longitudinal member.

It is important to note that the apparatus and methods as described herein are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. An apparatus for a sliding fenestration sash assembly comprising:

a frame having a first longitudinal member including at least one aperture;

a sliding sash movable between a fully closed position and a fully opened position; and a lock mechanism including a handle positioned in the sliding sash and being movable from a first handle position to a second handle position;

a pin operatively connected to the handle and movable between an extended position and a retracted position as the handle moves between the first handle position and the second handle position and;

the pin being biased into the aperture by at least one magnet when a longitudinal axis of the pin is substantially aligned with a longitudinal axis of the aperture, wherein the sliding sash is locked in a partially open position between the fully closed position and the fully open position when the pin is within the aperture, the sliding door cannot be moved from the partially open position toward the fully open position when the handle is in the first handle position.

2. The apparatus of claim 1, wherein the sliding sash slides between a closed position and an open position in a first direction that is generally parallel to a plane defined by the sliding sash; the first longitudinal member having a longitudinal axis that is parallel to the first direction.

3. The apparatus of claim 2, wherein the at least one magnet includes a first magnet positioned proximate the free end of the pin and a second magnet positioned in the first longitudinal member proximate the aperture.

4. The apparatus of claim 3, wherein handle translates the pin along its longitudinal axis and rotates the pin about its longitudinal axis as the handle is moved from the first handle position to the second handle position.

5. The apparatus of claim 4, wherein the first magnet and the second magnet is a correlated magnet, the first magnet and second magnet causing the free end of the pin to be biased into the aperture only when the first magnet and the second magnet are aligned along and about the longitudinal axis of the pin.

6. The apparatus of claim 5, wherein the pin is in alignment with the aperture when the sliding sash is located between a closed position and a fully open position.

7. The apparatus of claim 1, wherein a free end of the pin is biased toward the first longitudinal member only when the longitudinal axis of the pin is substantially aligned with the longitudinal axis of the aperture.

8. The apparatus of claim 7, wherein the sliding sash is a horizontal sliding sash having a vertical stile, the first longitudinal member is a header and the second longitudinal member is a vertical jamb, and the pin moves in a direction parallel to a longitudinal axis of the vertical jamb and a longitudinal axis of the vertical stile.

9. The apparatus of claim 8, wherein the vertical stile includes a leading surface facing the second longitudinal member, the handle includes a leading portion generally parallel with the leading surface of the stile, the handle including a first handle side portion generally parallel with a front side of the vertical stile, and a second handle side portion being generally parallel with a rear side of the vertical stile, the handle sliding upwardly and downwardly generally parallel to a plane defined by the leading portion from the first handle position to the second handle position.

10. The apparatus of claim 8, wherein the handle includes a base portion that pivots about an axis that is parallel with the sliding door plane, a free end of the handle extending beyond one of the a front portion of the stile and a rear portion of the stile in the first position and being completely between the front side and the rear side of the stile in the second position.

11. The apparatus of claim 8, wherein the frame includes a third longitudinal member spaced from and parallel to the second longitudinal member, a primary lock operatively locks the sliding sash to the third longitudinal member, the guide plate including a second beveled portion at a second terminal end of the guide plate.

12. The apparatus of claim 7, wherein the sliding sash is a vertical sliding sash including a horizontal stile extending generally parallel to the second longitudinal member, the first longitudinal members is a vertical jamb and the second longitudinal member is a horizontal header, and the pin moves in a direction parallel to a longitudinal axis of the horizontal stile and a longitudinal member of the horizontal header.

13. The apparatus of claim 1, wherein the handle includes a base that pivots about an axis perpendicular to a plane defined by the sliding sash, and a free end, the handle defining a handle vector extending from the base toward the free end, the handle vector pointing toward the first longitudinal member in the first position and away from the first longitudinal member in the second position.

14. The apparatus of claim 1, further including a biasing member biasing the pin away from the longitudinal member, the biasing member having a force that is less than and opposite a magnetic force of the at least one magnet.

15. The apparatus of claim 14, wherein the at least one magnet includes a first and second correlated magnet located in the pin and header respectively and providing a magnetic force only when the first and second correlated magnets are aligned about the longitudinal axis of the pin.

16. The apparatus of claim 1 wherein the frame includes a first vertical jamb member, a second vertical jamb member parallel to and spaced from the first jamb member, the first vertical jamb member and second vertical jamb member is perpendicular to the first longitudinal member;

wherein the sliding sash includes a first vertical stile and a second vertical stile spaced from and parallel toe the first vertical stile, the first vertical stile being adjacent the first vertical jamb when the sliding sash is in a closed position, the second vertical stile having a leading edge perpendicular to a front surface of the second vertical stile and a rear surface of the second vertical stile, the front surface and rear surfaces of the second vertical stile being parallel with a plane defined by the sliding door; and wherein the handle operatively rotates the pin about the longitudinal axis of the as the handle moves between the first handle position and the second handle position.

17. The apparatus of claim 16, wherein the at least one magnet is a pair of correlated magnets.

18. An apparatus for a sliding fenestration sash assembly comprising:

a frame having a first longitudinal member including at least one aperture;

a sliding sash; and a lock mechanism including a handle positioned in the sliding sash and being movable from a first handle position to a second handle position;

a pin operatively connected to the handle and movable between an extended position and a retracted position as the handle moves between the first handle position and the second handle position and;

the pin being biased into the aperture by at least one magnet when a longitudinal axis of the pin is substantially aligned a longitudinal axis of the aperture, wherein the at least one magnet includes a first magnet and the second magnet is a correlated magnet, the first magnet and second magnet causing the free end of the pin to be biased into the aperture only when the first magnet and the second magnet are aligned along and about the longitudinal axis of the pin.

19. The apparatus of claim 18, wherein handle translates the pin along its longitudinal axis and rotates the pin about its longitudinal axis as the handle is moved from the first handle position to the second handle position.

20. An apparatus for a sliding fenestration sash assembly comprising:

a frame having a first longitudinal member including at least one aperture;

a sliding sash; and a lock mechanism including a handle positioned in the sliding sash and being movable from a first handle position to a second handle position;

a pin operatively connected to the handle and movable between an extended position and a retracted position as the handle moves between the first handle position and the second handle position and the pin being biased into the aperture by at least one magnet when a longitudinal axis of the pin is substantially aligned a longitudinal axis of the aperture, where in the handle includes a front portion generally parallel to the leading edge surface of the stile, and a first handle side portion generally parallel with a front side of the stile, and a second handle side portion being generally parallel with a rear side of the stile, the handle slidingly moves upwardly and downwardly from the first handle position to the second handle position.

* * * * *